US010226784B2

(12) United States Patent
Moretti

(10) Patent No.: US 10,226,784 B2
(45) Date of Patent: Mar. 12, 2019

(54) DISPENSING DEVICE OF A FLUID SUBSTANCE

(71) Applicant: LUMSON S.p.A., Capergnanica (IT)

(72) Inventor: Matteo Moretti, Crema (IT)

(73) Assignee: LUMSON S.P.A., Capergnanica (CR) (IT)

( * ) Notice: Subject to any disclaimer, the term of this patent is extended or adjusted under 35 U.S.C. 154(b) by 0 days.

(21) Appl. No.: 15/785,802

(22) Filed: Oct. 17, 2017

(65) Prior Publication Data

US 2018/0133733 A1 May 17, 2018

(30) Foreign Application Priority Data

Nov. 15, 2016 (IT) ..... 102016000115319

(51) Int. Cl.
*B05B 11/00* (2006.01)

(52) U.S. Cl.
CPC ..... *B05B 11/3038* (2013.01); *B05B 11/0067* (2013.01); *B05B 11/3053* (2013.01); *B05B 11/3061* (2013.01); *B05B 11/3047* (2013.01)

(58) Field of Classification Search
CPC ..... B05B 11/3047; B05B 11/3061; B05B 11/0067; B05B 11/3038; B05B 11/3053; B05B 5/5225; B05B 11/3023; B65D 83/207
See application file for complete search history.

(56) References Cited

U.S. PATENT DOCUMENTS 5,096,098 A * 3/1992 Garcia ..... B05B 11/3053 222/402.13
8,028,862 B2 * 10/2011 Rossignol ..... B05B 11/3004 222/256
9,393,582 B2 * 7/2016 Goettke ..... B05B 11/3001
(Continued)

FOREIGN PATENT DOCUMENTS

JP 2008029959 A 2/2008
JP 2009056375 A 3/2009

OTHER PUBLICATIONS

Search Report and Written Opinion dated Jul. 13, 2017 for Italian patent application No. 102016000115319.

*Primary Examiner* — Patrick M Buechner
*Assistant Examiner* — Robert Nichols, II
(74) *Attorney, Agent, or Firm* — Vorys, Sater, Seymour and Pease LLP

(57) ABSTRACT

Fluid substance dispensing device including a dispensing button provided with a hole for tight coupling with a hollow stem of a pump or a valve, and a dispensing opening associated with a shutter that, at least when subjected to fluid substance to be dispensed pressure, translates in contrast to an elastic element freeing the dispensing opening. The shutter having at least one projection cooperating with mechanical opening element associated with the dispensing button. The opening element devoid of fluid substance passages and having a first fixing portion to the dispensing button and a second portion to abut, in use, a fixed part from which the stem extends. At least one elastically deformable part mutually interconnecting the first and second portions. An actuation lever extending from second portion cooperating with the projection to open the shutter when the second portion contacts fixed part consequently deforming elastically deformable part.

10 Claims, 3 Drawing Sheets

(56) References Cited

U.S. PATENT DOCUMENTS

| | | | | |
|---|---|---|---|---|
| 2005/0006411 | A1* | 1/2005 | Kuwahara | B05B 11/3004 222/321.1 |
| 2005/0115990 | A1* | 6/2005 | Kang, III | B05B 11/3001 222/321.9 |
| 2005/0211798 | A1* | 9/2005 | Garcia | B05B 11/3053 239/333 |
| 2009/0272765 | A1* | 11/2009 | Seki | B05B 11/3053 222/321.3 |
| 2010/0224652 | A1* | 9/2010 | Lim | A45D 34/04 222/256 |

* cited by examiner

DISPENSING DEVICE OF A FLUID SUBSTANCE

This claims the benefit of Italian patent application no. 102016000115319, filed Nov. 15, 2016.

FIELD OF THE INVENTION

The present innovation relates to a dispensing device of a fluid substance.

In particular it refers to a dispensing device of a fluid substance such as a cream or a liquid that must be sprayed/dispensed.

STATE OF THE ART

Various dispensing devices are known that are normally installed on a container provided with a pump or a valve (in the case of pressurised containers).

Known valves or pumps comprise a hollow stem, on which a dispensing button is fitted. Some types of dispensing button have a dispensing opening that is closed by a shutter. When the button is actuated the fluid substance that flows in the cavity of the stem reaches a chamber arranged between the shutter and the opening. An increase of the pressure inside the chamber causes the shutter (usually mounted in contrast to a spring) to move, so as to free the dispensing opening; this allows the delivery of the fluid substance.

Known systems have trigger problems. Indeed, at the first actuation of the pump (or of the valve), the air trapped in the stem, pushed by the pressure of the fluid substance that comes through it, flows towards the said chamber and compresses there forming a cushion that prevents the correct filling of the chamber with the fluid substance.

Indeed, the density of the air is not sufficient to allow the shutter to move enough to allow the delivery of the fluid substance through the opening.

In known devices, therefore, there are small (venting) openings that allow the air present in the chamber in front of the dispensing opening at the first actuation of the pump (or valve) to be vented.

The system is effective; however, in time, after many actuations of the pump, the fluid substance dispensed, particularly if it is not very dense like in the case of light creams or spray products, drips through the vent(s) designed for the triggering step, producing losses of product that 'soils' the dispenser or the container.

This cannot be tolerated especially in high-end products.

Moreover, although only minimal, there is a waste of product that can no longer be used.

SUMMARY OF THE INVENTION

The purpose of the present innovation is to provide a dispensing device of a fluid substance that overcomes the drawbacks of the prior art.

A further purpose of the innovation is to provide a dispensing device that allows easy system triggering at a first actuation, but that avoids or minimises waste of fluid substance dispensed and/or percolation.

This and other purposes are accomplished by a dispensing device of a fluid substance in accordance with the technical teachings of the attached claims.

BRIEF DESCRIPTION OF THE FIGURES

Further characteristics and advantages of the innovation will become clear from the description of a preferred but not exclusive embodiment of the device, illustrated as an example and therefore not for limiting purposes in the attached drawings, in which.

DETAILED DESCRIPTION OF THE INVENTION

Figure 1:
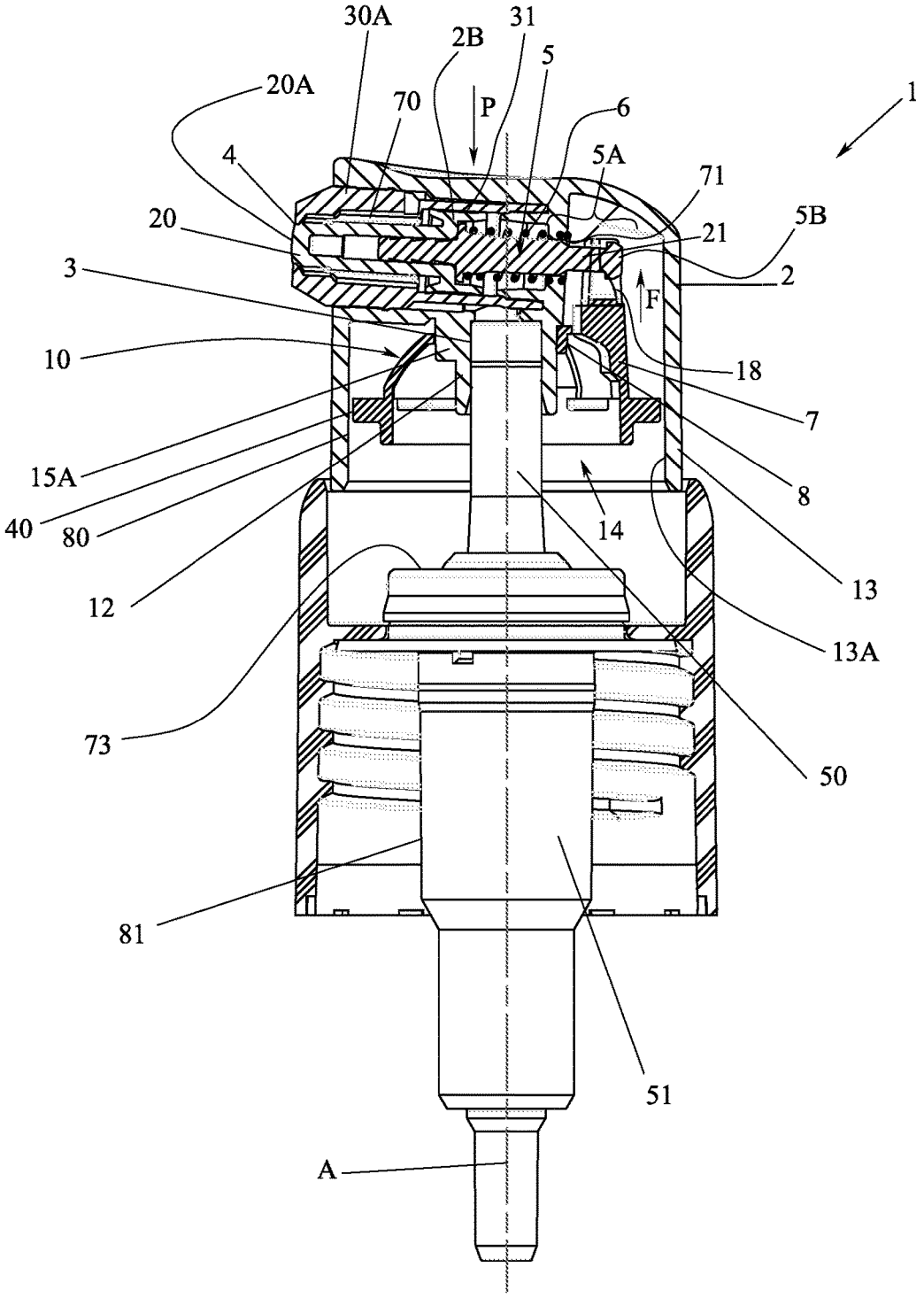
FIG. 1 is a simplified axial section of the device of the present innovation when associated with a pump (only partially illustrated)

With reference to the cited figures, a dispensing device of a fluid substance is shown, wholly indicated with reference numeral 1.

In the present text, the term fluid substance is meant to indicate a dense or light cream, or a liquid intended to be sprayed, like for example a deodorant, or any other type of spray. As an example, the fluid substance can be sun cream, sun milk, hair spray, foamed products, etc.

The dispensing device 1 comprises a dispensing button 2 provided with a hole 3 configured for sealed coupling with a hollow stem 50 of a pump 51 (or of a valve of the conventional type).

The pump or valve makes the fluid substance available inside the cavity of the stem, thus conveying it to the dispensing button. Therefore, the pump and the valve are part of a pressurisation system of the cavity of the stem through the fluid substance that is taken from a container with which the pump or valve are associated.

Of course, the pump can be of any known type, like for example of the type able to be associated with an airless container. The valve, on the other hand, can be associated with a known pressurised container.

The dispensing button can have a dispensing opening 4 associated with a shutter 5.

As can be seen from the drawings, the shutter 5 can comprise a piston 20B adapted to seal on a cylindrical surface 31 integral with the dispensing button 2. The cylindrical surface 31 can be formed directly in the dispensing button, but advantageously it can be made on an insert 30A like the one of FIG. 1, in which the dispensing opening 4 is also made.

Mounting a solution like the one described is particularly simple since it is possible to pre-assemble the insert/shutter/spring group (see FIG. 5), which is simply inserted in a seat suitably provided in the dispensing button 2, inside which it is snap-locked for example through at least one tooth 60 (here of the annular type). As can be seen clearly from the aforementioned FIG. 5, the spring 6 is fitted with interference on a surface suitably provided of the shutter. Moreover, the insert 30A has an annular projection 35 that keeps the shutter inside it, once fitted.

As can be seen from the figures, the shutter can be made in two mutually connected parts. Specifically, the shutter can have a first piece 20 made of soft plastic (which can be: PE, LDPE, GOMMA, TPU, TPE, SILICONE), which comprises a tip 20A adapted for sealably closing the opening 4 and the aforementioned piston 20B. The piston 20B can have a first lip 36 facing the tip 20A that makes a seal on the surface 31, and a second lip 37 that substantially acts as a guide of the shutter and may not make a seal on the surface 31. The second piece 21 of the shutter 5 can be made of a more rigid material than that of the first piece 20. For example, such a material can be PP, POM, PBT, PET, PETG, etc.

Figure 5:
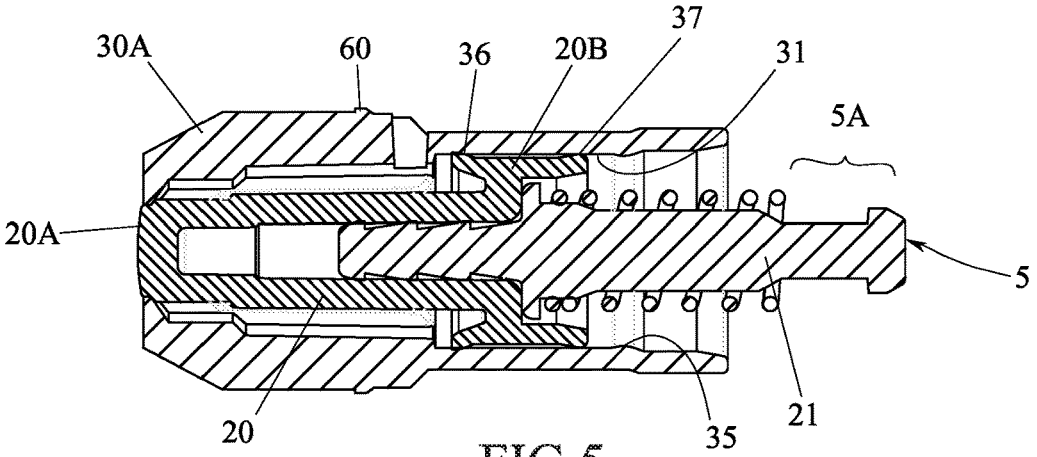
FIG. 5 is an enlarged longitudinal section of a part of the device of FIG. 1.

The first and the second piece of the shutter can simply be fixed together by interference or interlocking, as visible in FIG. 5.

The fact that the shutter 5 is made in two pieces (subsequently assembled) is particularly advantageous since it is possible to assemble onto the first piece 20 (always the same for every dispensing button) a second piece of different length, thus allowing the shutter 5 to be adapted to many buttons and therefore to different configurations of the dispensing device 1.

Figure 6:
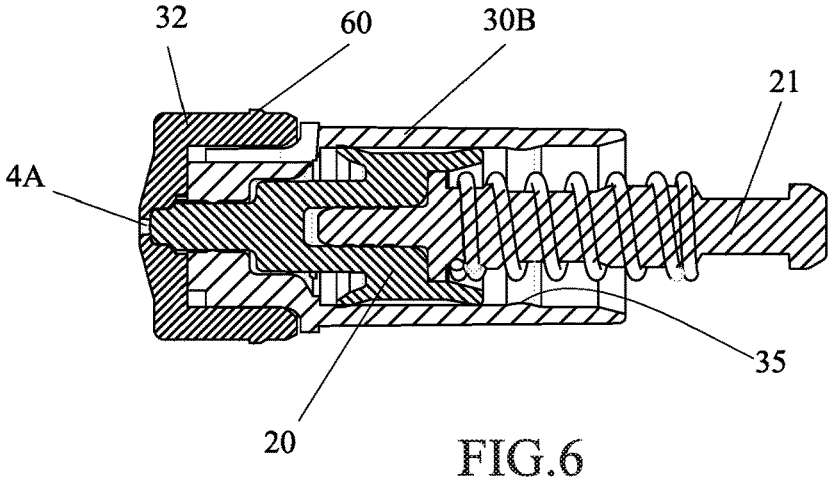
FIG. 6 is an enlarged longitudinal section of a part of a variant of the innovation.

The dispensing button 2 can be equipped with the opening 4/shutter 5 group just described (suitable for use with creams) or with the group shown in FIG. 6 suitable for use with liquids intended to be sprayed.

This figure uses the same reference numerals already used previously to indicate parts functionally analogous to those already described.

As can be seen, the second group has an insert 30B at the front of which a spraying pad 32 is fitted, on which the annular fixing tooth 60 of the entire group to the body of the button is formed, and on which the dispensing opening 4A is also formed.

Returning to the description of FIG. 1, it can easily be seen that, at least when the shutter 5 is subject to a pressure exerted by the fluid substance to be dispensed inside a chamber 70, it may translate in contrast to the spring 6 (or other elastic element) thus freeing the dispensing opening 4.

The already partially described shutter 5 has at least one projection 5A, which in use cooperates with a mechanical opening element 7 associated with the dispensing button 2.

Specifically, the projection 5A projects cantilevered through a hole 71 made in a wall of the body of the button 2.

Figure 2:
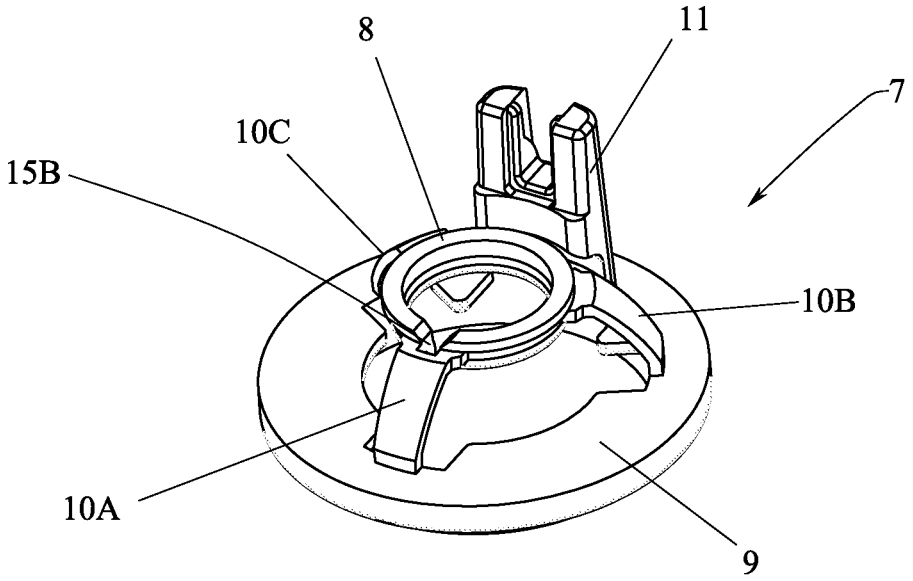
FIG. 2 is a perspective view of a component of the device of FIG. 1.
Figure 3:
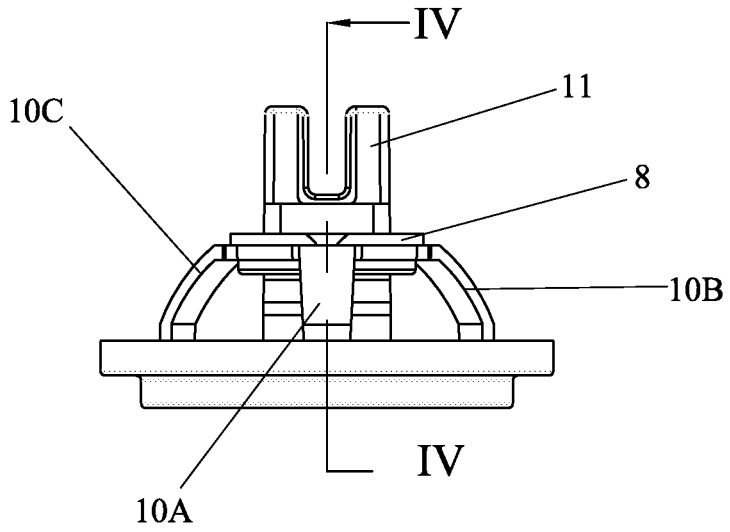
FIG. 3 is a front view of the component of FIG. 2.
Figure 4:
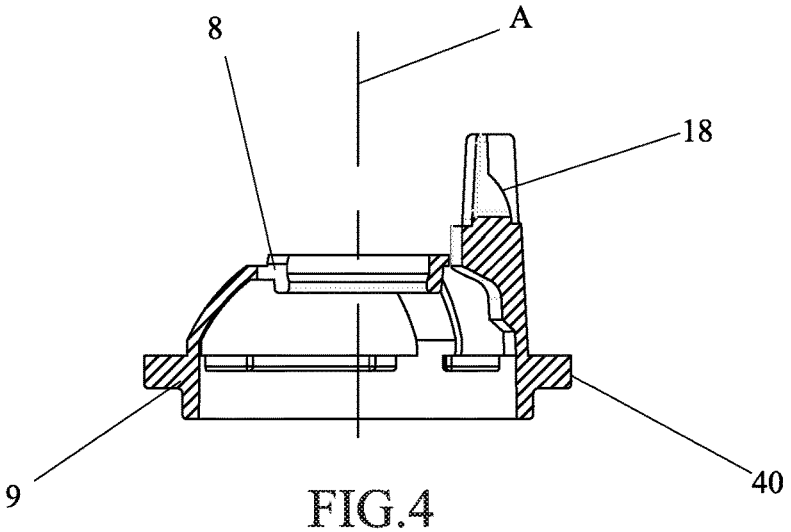
FIG. 4 is a section taken along the line IV-IV of FIG. 3.

The opening element 7 is best illustrated in FIGS. 2 to 4 and may constitute an independent element with respect to the dispensing button 2.

The opening element 7 is devoid of passages for the fluid substance to be dispensed, and does not have any part thereof that before or during use of the dispensing device comes into contact with the substance to be dispensed.

It has a first fixing portion 8 to the dispensing button and a second portion 9 with at least one part thereof adapted to abut, in use, a fixed part 73 from which the stem 50 extends.

The fixed part 73 can be a part of the pump 51 (or valve), of a fixing nut of the pump itself, a part of the container with which the pump is associated or any other part with respect to which the stem 50 is mobile.

As can be seen, in particular from FIG. 2, the first portion 8 and the second portion 9 are mutually interconnected by at least one elastically deformable part 10.

The elastically deformable part 10 is configured to allow an at least axial translation (along the axis A of FIGS. 1 and 4), of the second portion 9 with respect to the first. In fact, the deformable part acts as a spring, which, in rest position, restores the reciprocal position of the second portion with respect to the first (axial distance D1).

According to the embodiment described here, the elastically deformable part 10 comprises three curved wings 10A, 10B, 10C, which act as a "cup" spring arranged between the first and the second portion 9. Advantageously, the curved wings are made in one piece with the first and the second portion, for example by moulding of plastic material.

It should be stated that the configuration of the elastically deformable part can also be different. For example, there can be only two wings, or more than three, or a lever or leaf spring system.

An actuation lever 11 that is normally engaged with the projection 5A of the shutter, and cooperates with the latter for the forced mechanical opening of the opening 4, extends from the second portion 9 (advantageously in one piece).

The forced opening occurs when the dispensing button is pressed down fully (arrow P), in contrast to an elastic means (not shown) on which the stem 50 is mounted.

In this configuration the second portion 9 comes into contact with the fixed part 73 (of the pump, of the valve, of the ring nut etc. . . . ) and there is an at least axial translation of the second portion 9 with respect to the first portion 8, in contrast to the elastic deformation of the wings 10A, 10B, 10C.

Advantageously, the second portion 9 can comprise at least one guide surface 40 adapted for cooperating with a surface 13A of the dispensing button 2 to maintain an axial alignment between the second portion 9 and the dispensing button 2 within a predetermined tolerance. The axial alignment (within a predetermined tolerance) can also be obtained through a calibrated surface 80 of the second portion 9, which engages without interference and with limited clearance, on a corresponding surface 81 of the body of the pump.

After substantially fully pressing down the dispensing button, therefore, the actuation lever 11 translates towards the shutter (arrow F) cooperating with it to retract it with respect to the opening 4.

From what has been stated above, it can be seen that the opening of the shutter, according to the innovation, takes place only when the button is pressed down to a position close to its end of stroke (and the opening does not occur like in conventional systems as soon as the dispensing button undergoes a minimal pressing at the start of the stroke). The system thus configured (unlike conventional ones) can therefore be used both for creamy products (creams), and for products intended to be sprayed (sprays).

Advantageously, the actuation lever 11 can have a forked or U-shaped portion (clearly visible in FIG. 3) adapted to engage a mushroom-shaped end 5B of the projection 5A. Such a configuration makes it substantially easier to mount the opening element 7.

It should be stated that to expel the air trapped between the opening 4 and the shutter, even a minimal movement of the shutter is sufficient, generated even simply by the interaction between the lever 11 and the projection 5A.

Moreover, it is possible for the actuation lever 11 to have a cam surface 18 (see FIG. 4) cooperating with said projection 5A to stop it with respect to the opening 4, following a movement of the lever 11 with respect to the projection in the direction of the arrow F (i.e. substantially perpendicular with respect to the axis of the shutter.

In the case of presence of a cam surface 18, its height D2 (which will be <D1) and its profile can be configured to carry out an opening of the shutter only when the dispensing button 2 reaches an end-of-stroke position.

Advantageously, as can be seen from the drawings, the first portion is fitted externally (and locked there by interference) on a protruding part 12 (which can be cylindrical) of the dispensing button 2 in which the hole 3 for the stem 50 is made.

Moreover, the dispensing button 2 can comprise a skirt 13 that defines a space 14 inside which the opening element 7 can be completely accommodated; and this is of great benefit both to the aesthetics of the product, and to prevent foreign parts blocking the operativity of the dispensing device 1.

The mounting procedure of the dispensing device provides for the coupling of the body of the dispensing button with the insert 30A (or 30B) in which the shutter and the spring is premounted. Thereafter, the opening element 7 is positioned, which is angularly aligned with the body of the dispensing button 2; and this is to facilitate the centring between the lever 11 and the projection 5A of the shutter.

Such angular alignment can be obtained through a projection 15A of the dispensing button that is inserted in a seat 15B (suitably flared for centring) of the first portion 8 of the opening element.

Of course, it is possible to make the projection on the first portion, and a seat in the body of the dispensing button 2.

The dispensing device described above, at the first actuation (or during first actuations) by fully pressing down the dispensing button 2, makes it possible to obtain mechanical retraction of the shutter 5, with consequent expulsion through the opening 4 of an air cushion trapped in front of the opening itself.

In this way, it is possible to effectively trigger the dispensing device, and to fill the chamber 70 with the fluid substance to be dispensed.

At an actuation after triggering, it is no longer necessary to operate the dispensing button pressed in fully, thus mechanically opening the shutter, given that the pressure of the fluid substance in the chamber 70 is sufficient to allow the shutter to retract.

Various embodiments of the innovation have been described, but others can be devised by exploiting the same innovative concept.

The invention claimed is:

1. A dispensing device of a fluid substance, comprising a dispensing button provided with a hole configured for sealed coupling with a hollow stem of a pump or a valve, and a dispensing opening, the dispensing opening associated with a shutter which, at least when the shutter is subjected to a pressure exerted by the fluid substance to be dispensed, translates in contrast to an elastic element, thereby freeing the dispensing opening, the shutter having at least one projection cooperating with a mechanical opening element associated with the dispensing button, the opening element not comprising any part for contacting said fluid substance, the opening element having a first fixing portion fixed to the dispensing button and a second portion adapted to abut, in use, a fixed part from which the stem extends, the first fixing portion and the second portion being mutually interconnected by at least a elastically deformable part configured to allow at least an axial translation of the second portion with respect to the first fixing portion, an actuation lever extending from the second portion and cooperating with said projection to open the shutter when the second portion is in contact with the fixed part and the elastically deformable part is deformed.

2. The dispensing device according to claim 1, wherein the first portion is fitted on a protruding part of the dispensing button where said hole is formed.

3. The dispensing device according to claim 1, wherein the dispensing button comprises a skirt which defines a space within which the opening element is completely accommodated.

4. The dispensing device according to claim 1, wherein a first element between the opening element and the dispensing button comprises an angular alignment projection and a second element between the dispensing button and the opening element comprises a seat for accommodating said angular alignment projection.

5. The device according to claim 1, wherein the elastically deformable part comprises at least two flexible wings made integral with the first part and/or the actuation lever is made integral with the second portion.

6. The device according to claim 1, wherein the actuation lever is provided with a fork portion adapted to engage with a mushroom-shaped end of the projection.

7. The device according to claim 1, wherein the actuation lever is provided with a cam surface cooperating with said projection.

8. The device according to claim 1, wherein the shutter is formed of two pieces, a first piece of soft plastics, which comprises a tip adapted to close the opening and a piston adapted to seal on a cylindrical surface integral with the dispensing button, and a second piece made of a more rigid material than the first piece, which includes the projection and which is associated to the elastic element.

9. The device according to claim 8, wherein the cylindrical surface is formed on an insert permanently attached to the dispensing button and wherein said opening is formed directly into the insert or in a spraying pad associated with the insert and/or the dispensing button.

10. The device according to claim 1, wherein the second portion comprises at least one guide surface adapted to cooperate with a surface of the dispensing button to maintain an axial alignment between the second portion and the dispensing button within a predetermined tolerance.

* * * * *